US007114473B2

(12) United States Patent
Taki

(10) Patent No.: US 7,114,473 B2
(45) Date of Patent: Oct. 3, 2006

(54) VALVE DRIVING APPARATUS AND INTERNAL COMBUSTION ENGINE INCLUDING THE SAME

(75) Inventor: Isato Taki, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 39 days.

(21) Appl. No.: 10/897,835

(22) Filed: Jul. 22, 2004

(65) Prior Publication Data

US 2005/0022766 A1 Feb. 3, 2005

(30) Foreign Application Priority Data

Jul. 29, 2003 (JP) ..... 2003-282115

(51) Int. Cl.
*F01L 1/34* (2006.01)

(52) U.S. Cl. ..... 123/90.18; 123/90.16; 123/90.15

(58) Field of Classification Search ..... 123/90.18, 123/90.16, 90.31, 90.15
See application file for complete search history.

(56) References Cited

U.S. PATENT DOCUMENTS 3,481,314 A 12/1969 LeCrenn
6,000,368 A * 12/1999 Mikame ..... 123/90.18

FOREIGN PATENT DOCUMENTS

DE 344490 A1 6/1986
DE 698 06 833 T2 4/2003
GB 1 296 157 A 11/1972
JP 04187807 A 7/1992
JP 2000-170881 6/2000

OTHER PUBLICATIONS

Patent Abstracts of Japan for JP2000-170881 published on Jun. 23, 2000.
Patent Abstracts of Japan for JP04-187807 published on Jul. 6, 1992.
Office Action from German Patent and Trademark Office received on Feb. 27, 2006 for Aplication No. 10 2004 036 764.7-13 and its English translation.

* cited by examiner

*Primary Examiner*—Thai-Ba Trieu
*Assistant Examiner*—Zelalem Eshete
(74) *Attorney, Agent, or Firm*—Darby & Darby

(57) ABSTRACT

A three-dimensional cam of a three-dimensional map state, having uncountable cam profiles continuously ranged along a rotation axis direction, and a valve lifter following a cam surface of the three-dimensional cam are included, and a lift characteristic of a valve is continuously controlled by relative motions of the three-dimensional cam and the valve lifter. The three-dimensional cam has cam top portions formed to have a smoothly ranged edge line substantially along the rotation axis direction thereof, and a part of the edge line includes at least one valley portion to take on a row of peaks. The cam peak portion of the cam top portion which forms the valley portion of the edge line is moderately set to be deviated toward a delayed side with reference to the rotation direction of the cam from the other cam peak portions.

4 Claims, 13 Drawing Sheets

FIG.7A
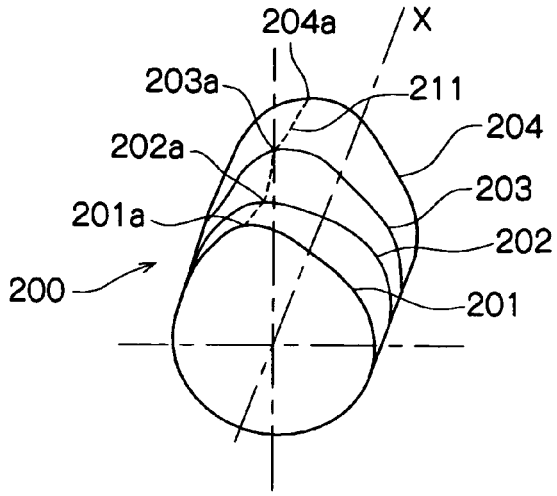
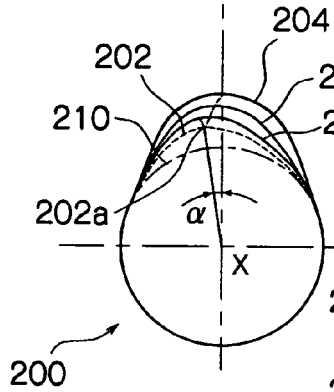
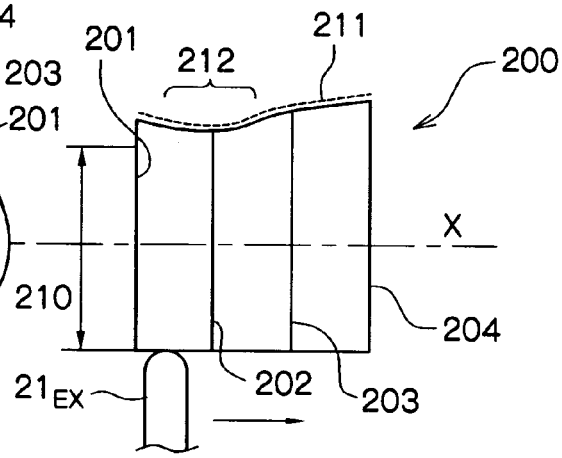
FIG.7B FIG.7C
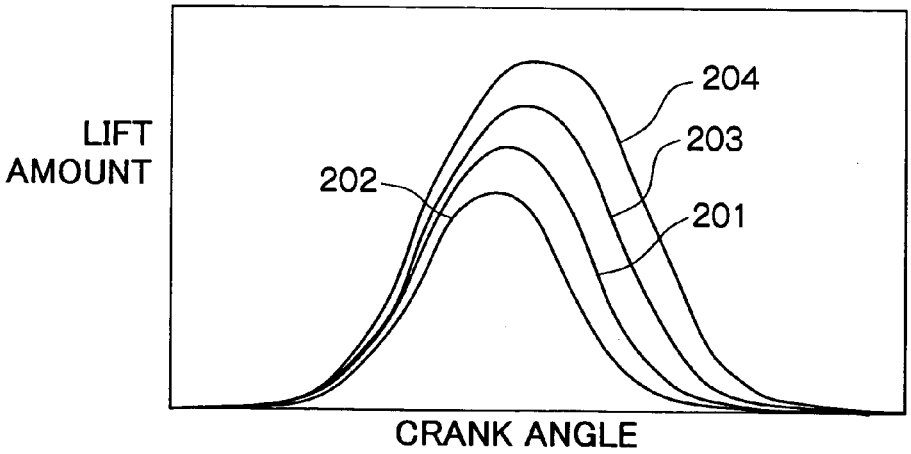
FIG.7D

FIG.10A
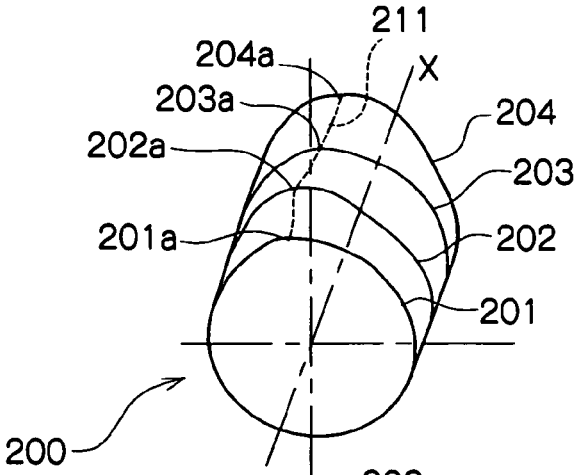
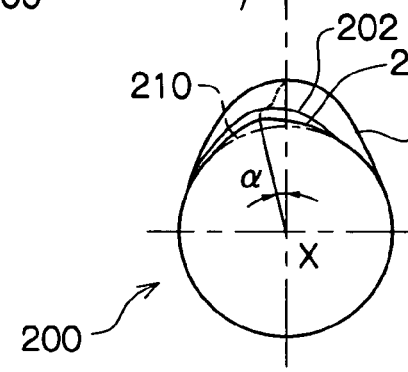
FIG.10B
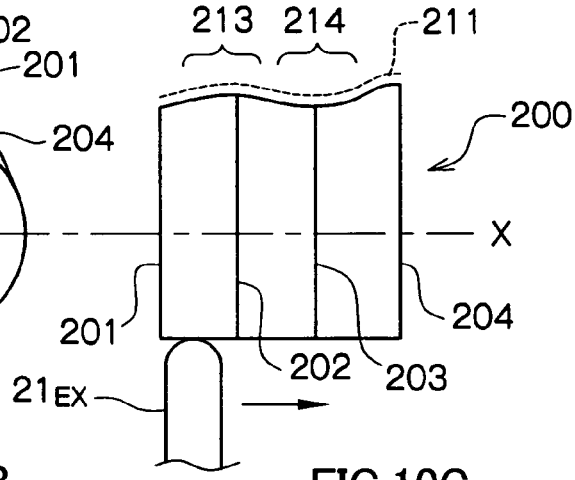
FIG.10C
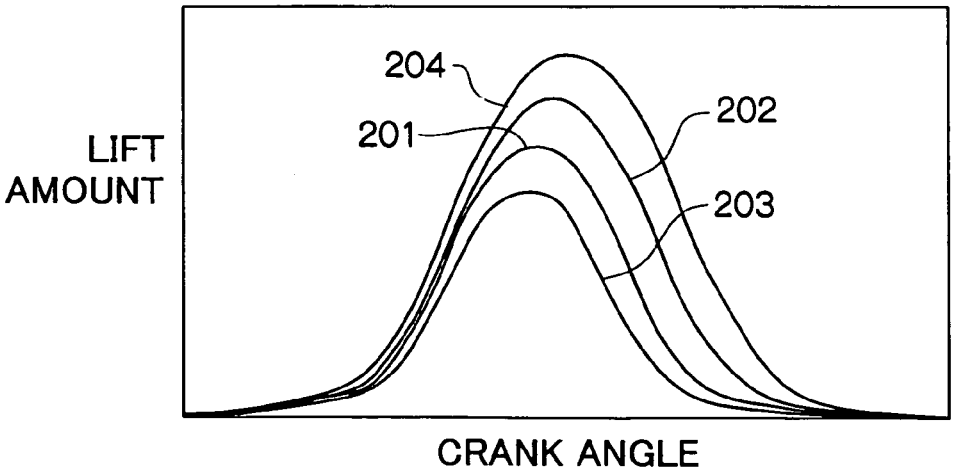
FIG.10D

FIG.11A
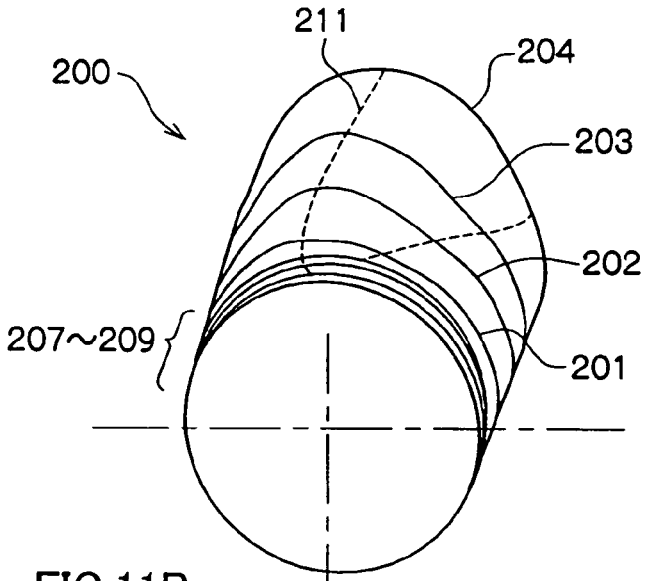
FIG.11B
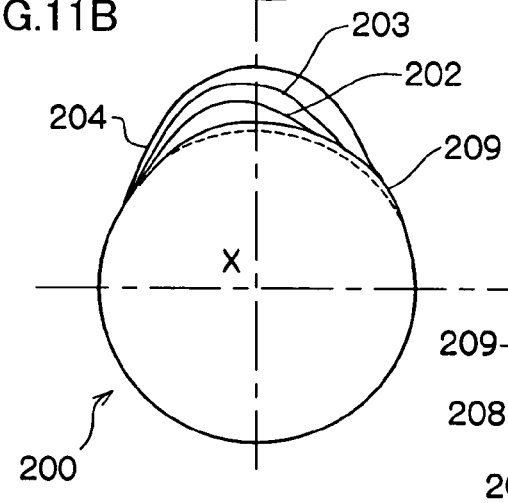
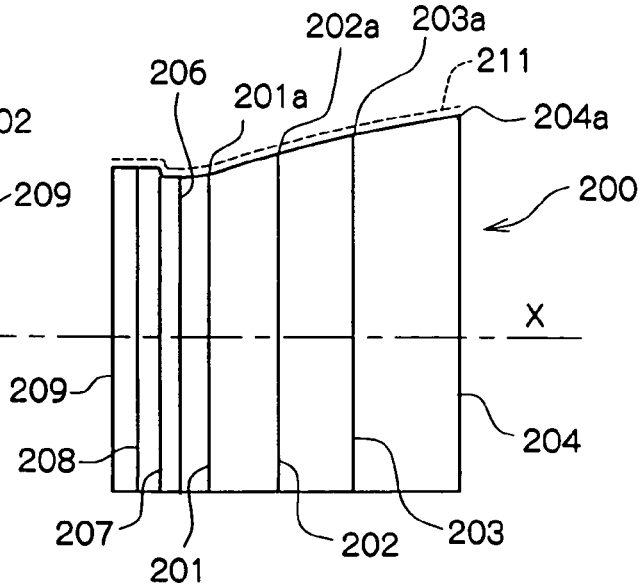
FIG. 11C

VALVE DRIVING APPARATUS AND INTERNAL COMBUSTION ENGINE INCLUDING THE SAME

CROSS-REFERENCE TO RELATED APPLICATIONS

This application is based upon and claims the benefit of priority from the prior Japanese Patent Application No. 2003-282115, filed on Jul. 29, 2003, the entire contents of which are incorporated herein by reference.

BACKGROUND OF THE INVENTION

1. Field of the Invention

The present invention relates to a valve driving apparatus for performing variable control of a lift amount, lift timing and an operation angle of a valve in accordance with an accelerator opening degree in an internal combustion engine in, for example, a motorcycle or an automobile.

2. Description of the Related Art

In this type of internal combustion engine, one having a valve driving mechanism including a three-dimensional cam for making the valve lift amount, the valve timing, and the valve actuated angle continuously variable, and a spherical cam follower in point contact with a cam surface provided at a valve lifter is known. See Japanese Laid-Open Patent Application No. Hei 4-187807 (JP '807). According to JP '807 the cam surface and the valve lifter are in point contact with each other, therefore the valve lifter is able to follow a complex cam surface shape.

In the conventional engine with the valve driving apparatus using such a three-dimensional cam, a shape of a cam top portion of an intake cam is formed to gradually increase the valve operation angle and the valve lift amount, in order to change an intake air amount to a cylinder from an idling status to a full opened status. Besides, an exhaust cam also has the shape to gradually increase the valve lift amount in accordance with the intake cam.

In this case, to perform an efficient gas exchange, the exhaust cam is required to have the valve operation angle about twice as large as that of the intake cam even when the intake cam is in the low lift status. To realize such a valve operation angle, the valve lift amount of the exhaust valve consequently should be twice or more as large as that of the intake valve considering the valve jump and the bounce (see a valve lift curve at the intake side and the exhaust side shown by a solid line in FIG. 13).

Here, a short summary of the valve driving apparatus having this type of three-dimensional cam is explained. For example, as shown in a FIG. 14, a roller state tappet is constantly in contact with a three-dimensional cam, which is slidably movable in an axial direction of a camshaft (both arrow X). And, a valve is driven to open and close via the tappet which moves vertically (both arrow Y).

However, the exhaust cam having the above-described characteristic suffers a very large reaction force from a valve spring, in a rotation region of an engine low load which is frequently used under a normal operation. Further, in a case when a cam top portion has a gradually increasing shape, only a specific portion of a tappet is in contact with the cam top portion (see a dotted circle portion in FIG. 14), and a biased abrasion will occur at the point of contact.

SUMMARY OF THE INVENTION

The present invention is made in view of the above circumstances, and has its object to provide a valve driving apparatus and an internal combustion engine including the same to prevent, for example, a biased abrasion from occurring especially around a valve lifter to improve durability.

A valve driving apparatus of the present invention is a valve driving apparatus including: a three-dimensional cam of a three-dimensional map state, having uncountable cam profiles continuously ranged along a rotation axis direction; and a valve lifter following a cam surface of this three-dimensional cam, wherein a lift characteristic of the valve is continuously controlled by relative motions of the three-dimensional cam and the valve lifter, and the three-dimensional cam has cam top portions formed to have a smoothly ranged edge line substantially along the rotation axis direction thereof, and a part of the edge line includes at least one valley portion to take on a row of peaks.

In the valve driving apparatus of the present invention, a cam peak portion of the cam top portion forming the valley portion is moderately set to be deviated toward a delayed side with reference to the rotation direction of the three-dimensional cam from the other cam top portions in the edge line.

In the valve driving apparatus of the present invention, one end side of the three-dimensional cam corresponds to a low engine rotation region, the other end side corresponds to a high engine rotation region, and the cam top portion to be the valley portion of the edge line forms a continuous valley portion relative to the cam top portions on both sides along the direction of rotation axis, and is also set to be deflected at one end side of the three-dimensional cam.

In the valve driving apparatus of the present invention, the edge line adjacent to the other end side of the three-dimensional cam has a cam peak portion high enough than the cam top portion to be the valley portion, and is formed to have a ridge portion keeping the height along the rotation axis direction.

The valve driving apparatus of the present invention is a valve driving apparatus including: a three-dimensional cam of a three-dimensional map state, having uncountable cam profiles continuously ranged along a rotation axis direction; and a valve lifter following a cam surface of this three-dimensional cam, wherein a lift characteristic of a valve is continuously controlled by a relative motion of the three-dimensional cam and the valve lifter, and the three-dimensional cam has cam top portions formed to have a smoothly ranged edge line substantially along the rotation axis direction thereof, and a part of the edge line includes at least one ridge portion which is set to be high relative to the cam top portions on both sides along the direction of rotation axis to take on a row of peaks.

The valve driving apparatus of the present invention is a valve driving apparatus including: a three-dimensional cam of a three-dimensional map state, having uncountable cam profiles continuously ranged along a rotation axis direction; and a valve lifter following a cam surface of this three-dimensional cam, wherein a lift characteristic of a valve is continuously controlled by a relative motion of the three-dimensional cam and the valve lifter, the three-dimensional cam has cam top portions formed to have a smoothly ranged edge line substantially along the rotation axis direction thereof, and a part of the edge line includes at least one valley portion and at least one ridge portion which is set to be high relative to the cam top portions on both sides along the direction of rotation axis to take on a row of peaks, thus, these valley portion and ridge portion form continuous valley portion and ridge portion along the rotation direction of the three-dimensional cam, to take on a mountain fold state.

The internal combustion engine of the present invention is an internal combustion engine controlling intake and exhaust by intake valves and exhaust valves, and includes any one of the above-described valve driving apparatuses at an intake side or an exhaust side.

BRIEF DESCRIPTION OF THE DRAWINGS

FIGS. 7A to 7D are a perspective view, a front view, and a side view of a three-dimensional cam, and a view showing a valve lift characteristic according to a first embodiment of the valve driving apparatus of the present invention;

FIGS. 10A to 10D are a perspective view, a front view, and a side view of a three-dimensional cam, and a view showing a valve lift characteristic according to another embodiment of the valve driving apparatus of the present invention;

FIGS. 11A to 11C are a perspective view, a front view, and a side view of a three-dimensional cam according to a further embodiment of the valve driving apparatus of the present invention;

DETAILED DESCRIPTION OF THE PREFERRED EMBODIMENTS

Embodiments according to the present invention will be explained hereinafter based on the drawings.

Figure 1:
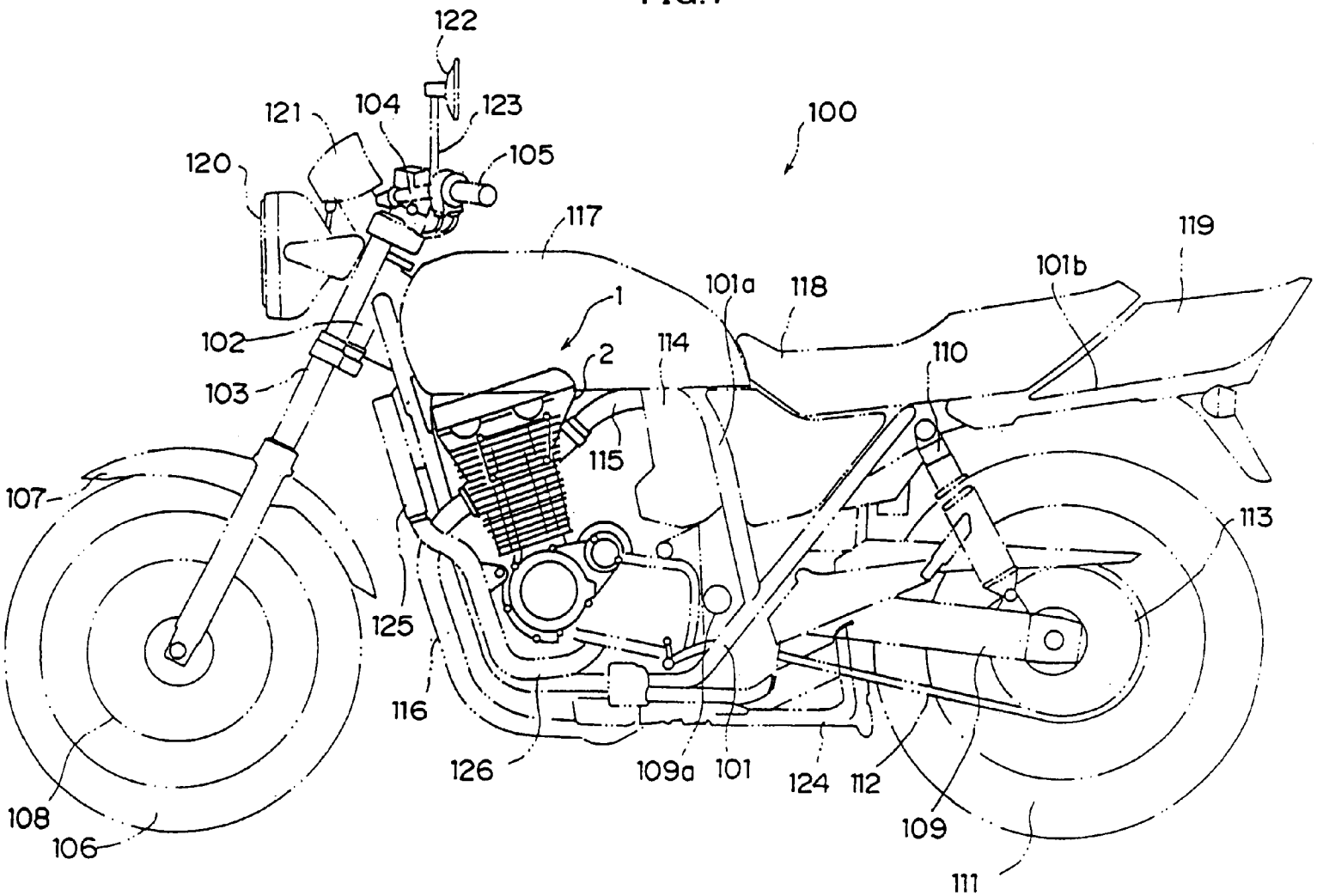
FIG. 1 is a view showing a constitution example of a motorcycle including an engine and its peripheral part according to an application example of the present invention.

FIG. 1 shows an entire motorcycle which loads an engine equipped with a radiator device according to the present invention. The present invention is effectively applicable to various types of gasoline engines loaded on not only motorcycles but also four-wheeled vehicles.

First, the entire motorcycle 100 according to this embodiment will be explained. In FIG. 1, two front forks 103 supported rotatably from side to side by a steering head pipe 102 are provided at a front part of a vehicle body frame 101 made of steel or an aluminum alloy material. A handle bar 104 is fixed to top ends of the front forks 103, and grips 105 are equipped at both ends of the handle bar 104. A front wheel 106 is rotatably supported at a lower part of the front forks 103, and a front fender 107 is fixed to cover an upper portion of the front wheel 106. The front wheel 106 has a brake disc 108 which rotates integrally with the front wheel 106.

A swing arm 109 is pivotally provided at a rear part of the vehicle body frame 101, and a rear shock absorber 110 is mounted between the vehicle body frame 101 and the swing arm 109. A rear wheel 111 is rotatably supported at a rear end of the swing arm 109, and the rear wheel 111 is rotationally driven via a driven sprocket 113 with a chain 112 wound around it.

An air-fuel mixture is supplied to an engine unit 1 loaded on the vehicle body frame 101 from an intake pipe 115 connected to an air cleaner 114, and an exhaust gas after combustion is exhausted through an exhaust pipe 116. The air cleaner 114 is placed in a large space behind the engine unit 1, and under a fuel tank 117 and a seat 118 for securing a volumetric capacity. Consequently, the intake pipe 115 is connected to a rear side of the engine unit 1, and the exhaust pipe 116 is connected to a front side of the engine unit 1.

The fuel tank 117 is loaded at an upper position from the engine unit 1, and the seat 118 and a seat cowl 119 are connectively provided behind the fuel tank 117.

Further, in FIG. 1, reference numeral 120 denotes a head lamp, reference numeral 121 denotes a meter unit including a speed meter, a tachometer, various kinds of indicator lamps or the like, and reference numeral 122 denotes a rear-view mirror supported by the handle bar 104 via a stay 123. A main stand 124 is pivotally attached to a lower part of the vehicle body frame 101, which allows the rear wheel 111 to be in contact with the ground and lift from the ground.

The vehicle body 101 is provided to extend from the head pipe 102 provided at the front part diagonally downward to the rear, and after it is bent to wrap a portion under the engine unit 1, it forms a pivot 109*a* which is a pivoted portion of the swing arm 109, and connects to a tank rail 101*a* and a seat rail 101*b*.

This vehicle body frame 101 is provided with a radiator 125 in parallel with the vehicle body frame to avoid interference with the front fender 107, and a cooling water hose 126 is placed along the vehicle body frame 101 from this radiator 125 and communicates with the engine unit 1 without interfering with the exhaust pipe 116.

Figure 2:
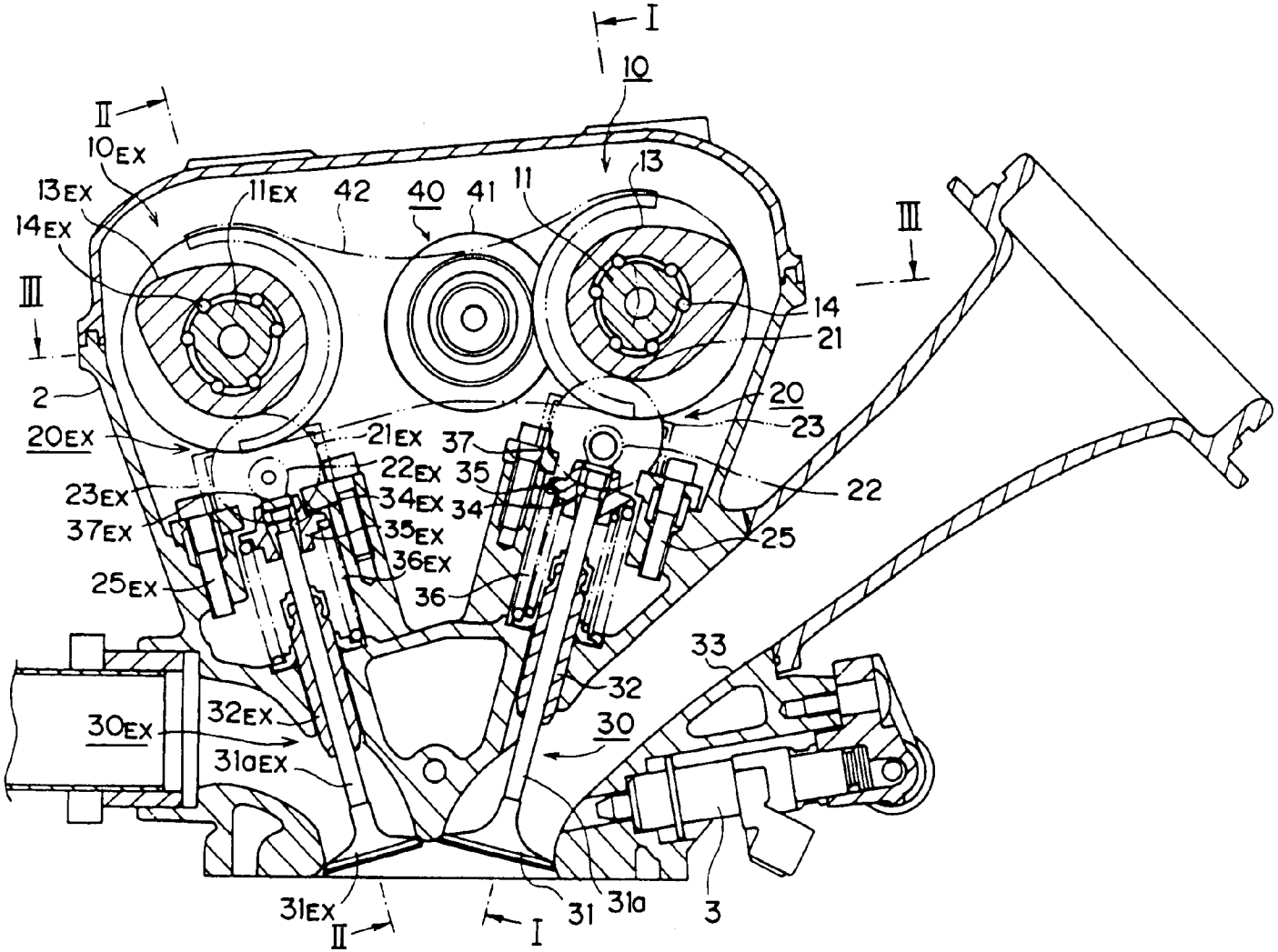
FIG. 2 is a sectional view showing a part of a valve driving apparatus of the present invention.
Figure 3:
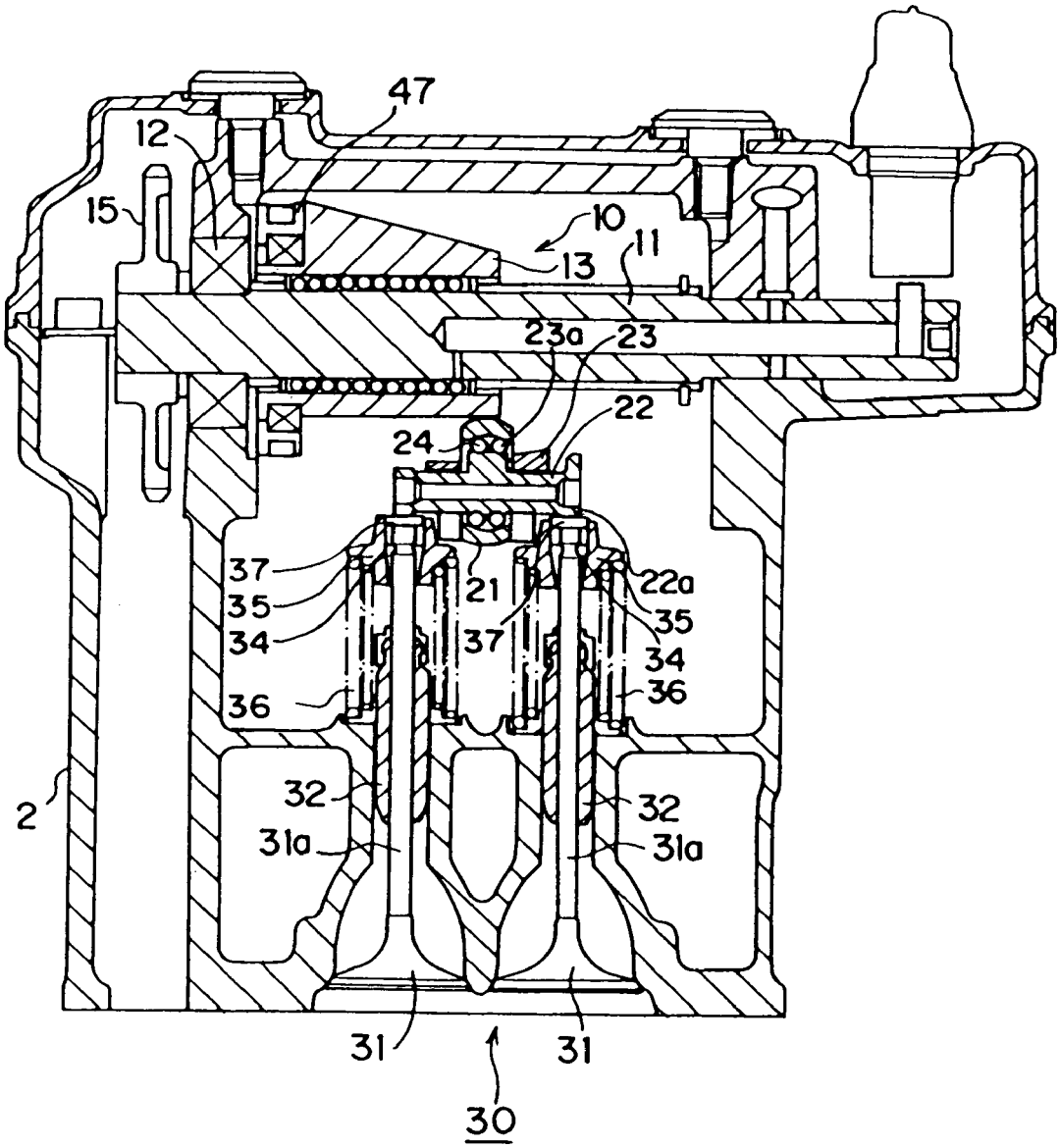
FIG. 3 is a sectional view taken along the line I—I in FIG. 2.
Figure 4:
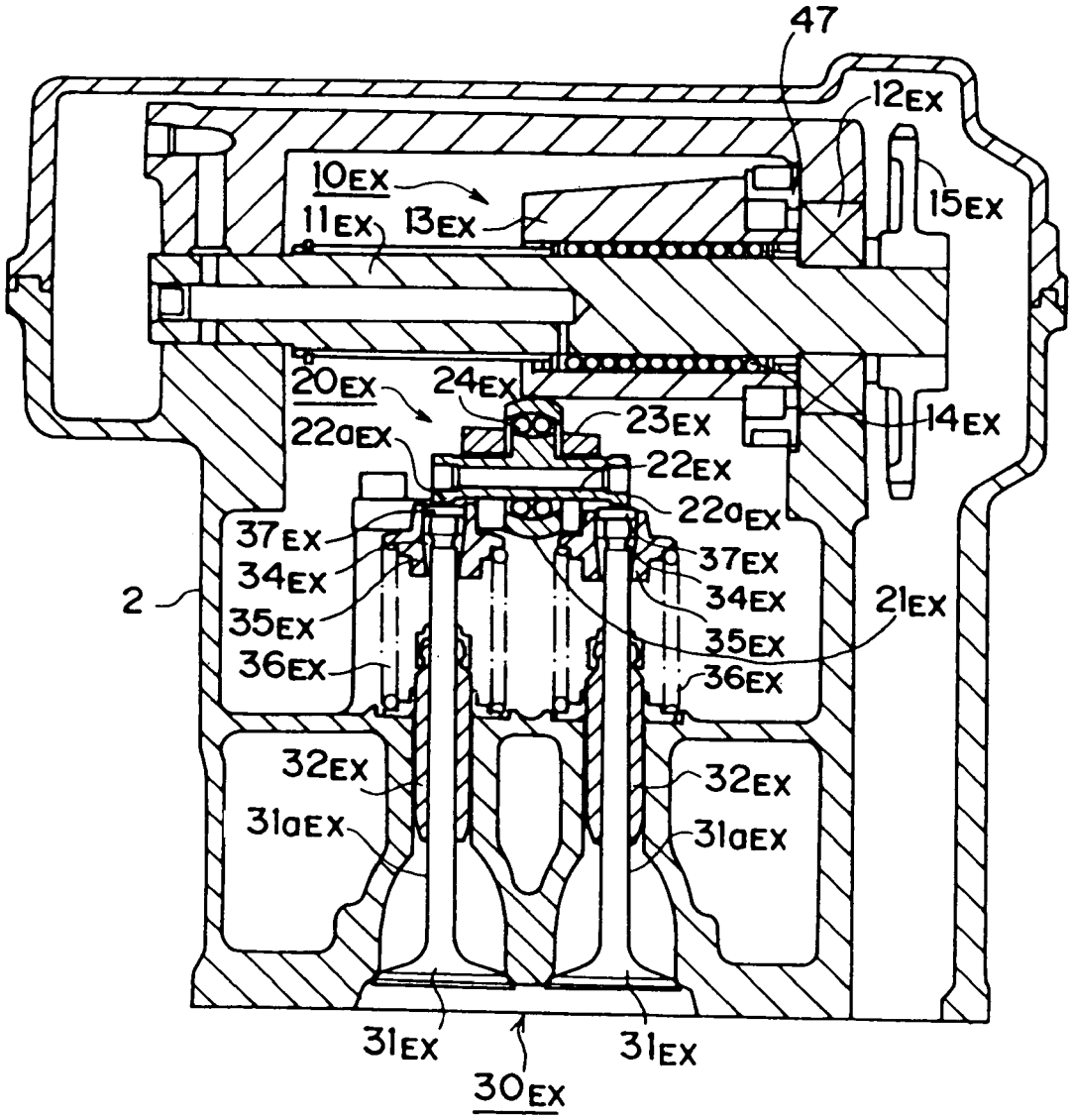
FIG. 4 is a sectional view taken along the line II—II in FIG. 2.
Figure 5:
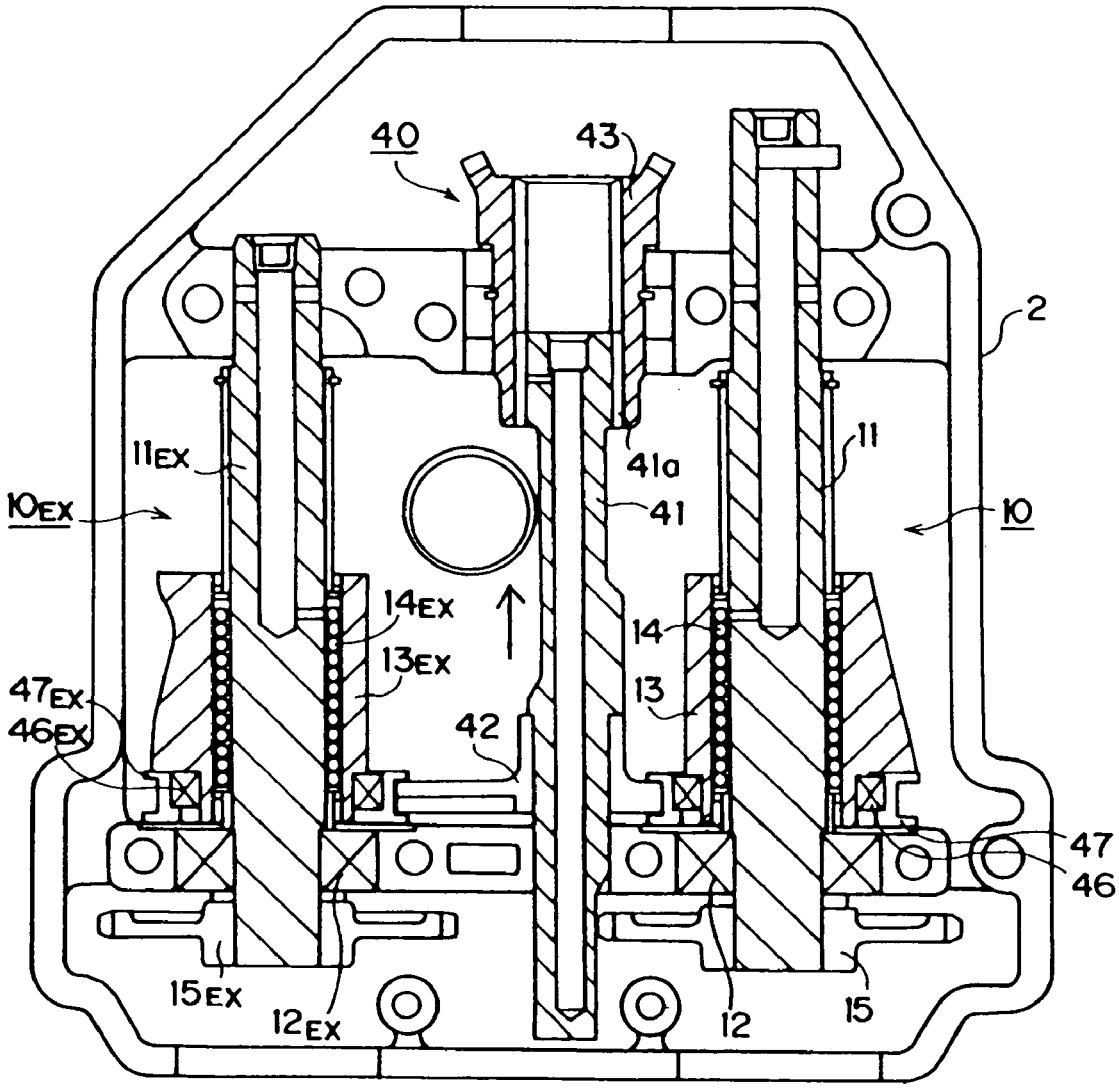
FIG. 5 is a sectional view taken along the line III—III in FIG. 2.

Next, FIG. 2 is a sectional view of an essential part of a valve driving apparatus of the present invention, FIG. 3 is a sectional view taken along the line I to I in FIG. 2, FIG. 4 is a sectional view taken along the line II to II in FIG. 2, and FIG. 5 is a sectional view taken along the line III to III in FIG. 2. A piston reciprocates up and down inside a cylinder of the engine unit 1 which is an internal combustion engine, and the valve driving apparatus is housed in a cylinder head 2 placed at an upper portion of the piston. The engine unit 1 described in this embodiment is a single-cylinder engine, which has two valves at the intake side (IN) and the exhaust side (EX), respectively.

At the intake side, the valve driving apparatus of this embodiment includes a cam/camshaft unit 10, a tappet unit 20 placed at an underside of the cam/camshaft unit 10, and a valve unit 30 for performing an intake control. At the exhaust side, the apparatus includes a cam/camshaft unit $10_{EX}$, a tappet unit $20_{EX}$ placed at an underside of the cam/camshaft unit $10_{EX}$, and a valve unit $30_{EX}$ for performing an exhaust control.

The apparatus further includes an accelerator shaft unit 40 for shifting cams 13 and $13_{EX}$ of the cam/camshaft units 10 and $10_{EX}$ in accordance with an accelerator opening degree. In this embodiment, the accelerator shaft unit 40 is placed between the cam/camshaft unit 10 at the intake side and the cam/camshaft unit $10_{EX}$ at the exhaust side, and used commonly at the intake side and the exhaust side.

In the cam/camshaft unit 10 at the intake side, a camshaft 11 rotatably supported inside the cylinder head 2 via a bearing 12 is provided, as shown in FIG. 3 or FIG. 5. A sprocket 15 is fixed to one end of the camshaft 11, and a cam chain is mounted to be wound around between the sprocket 15 at the intake side, a sprocket $15_{EX}$ fixed to one end of the camshaft $11_{EX}$ at the exhaust side, and a drive sprocket fixed to one end of a not shown crankshaft.

A cam 13 is mounted to the camshaft 11 slidably in an axial direction thereof. In this example, a spline with balls 14 interposed between the camshaft 11 and the cam 13 is constituted, so that relative rotation of the cam 13 and the camshaft 11 is restrained, and also the cam 13 makes a linear movement (linear motion). The camshaft 11 has a hollow structure, and a lubricant oil path is formed in its hollow interior part to make it possible to, for example, fill oil to the spline portion.

Here, the cam 13 is constituted as a "three-dimensional cam", and has a cam surface 13*a* inclined in a longitudinal direction (axial direction of the camshaft 11), which is formed into a shape to change the valve lift amount continuously. In this case, it is set such that the cam operation angle and lift timing are changed synchronously with the cam height, that is to say, the cam operation angle becomes larger as the valve lift amount becomes larger, and further the lift timing of the valve is also capable of being changed.

Incidentally, the cam/camshaft unit $10_{EX}$ at the exhaust side has the same basic constitution as the cam/camshaft unit 10 at the intake side as shown in FIG. 4 or FIG. 5, but the concrete characteristics of the cam $13_{EX}$ are different from those of the cam 13. The concrete constitution of the cam $13_{EX}$ will be described later.

In the tappet unit 20 at the intake side, a tappet roller 21 of which outer circumference surface is formed to be a spherical surface is included as shown in FIG. 3, and the outer circumference surface comes in contact with the cam 13. An arm member 22 is placed inside the tappet roller 21. An inner circumference surface of the tappet roller 21 is made a spherical surface, and balls 24 are interposed between the inner circumference surface and a large diameter portion at a center of the arm member 22. Accordingly, the tappet roller 21 is rotatably supported via the balls 24 and the arm member 22 is made swingable. Thereby the tappet roller 21 is capable of rotating normally owing to a core adjusting function even when the arm member 22 is inclined against the tappet roller 21.

A tappet guide 23 is placed to cover the arm member 22. The tappet guide 23 has an inversed concave shape when seen from a front direction (FIG. 2), and both end portions of the arm member 22 are protruded from both end openings of the inversed concave shape as shown in FIG. 3. The tappet guide 23 is fixed to the cylinder head 2 by a mounting bolt 25.

A guide hole 23*a* is formed on an upper surface of the tappet guide 23, and the tappet roller 21 is placed inside the guide hole 23*a*. The guide hole 23*a* is formed along an axial direction of a valve stem, whereby the tappet roller 21 becomes movable in only the axial direction of the valve stem. The tappet roller 21 is pressed by the cam surface 13*a* of the cam 13, and thereby the tappet roller 21 functions as a valve lifter for advancing and retreating the valve. At both end portions of the arm member 22, pressing portions 22*a* abutting on tappet shims 37 of the valve unit 30 which will be described later are provided.

The tappet unit $20_{EX}$ at the exhaust side has the same basic constitution as the tappet unit 20 at the intake side as shown in FIG. 4.

The valve unit 30 at the intake side includes, as shown in FIG. 2 and FIG. 3, two intake valves 31 in which valve stems 31*a* are guided by valve guides 32. As a result that the intake valve 31 is lifted, an air-fuel mixture of air introduced from the air cleaner 114 via an intake port 33, and a fuel sprayed from an injector 3 placed at a downstream side of the intake port 33 is introduced into a combustion chamber.

Valve retainers 35 are provided at end portions of the respective valve stems 31*a* via cotters 34, and an elastic force of valve springs 36 acts on the valve retainers 35. Further, the tappet shims 37 are mounted at top end openings of the valve retainers 35, and the valve retainers 35 are pressed by the pressing portions 22*a* of the arm member 22 via these tappet shims 37.

The valve unit $30_{EX}$ at the exhaust side has the same basic structure as the valve unit 30 at the intake side as shown in FIG. 2 and FIG. 4.

The accelerator shaft unit 40 includes, as shown in FIG. 2 or FIG. 5, an accelerator shaft 41 placed between the camshafts 11 and $11_{EX}$ in parallel, and an accelerator fork 42 fixed to the accelerator shaft 41 and connected to the cams 13 and $13_{EX}$.

Figure 6:
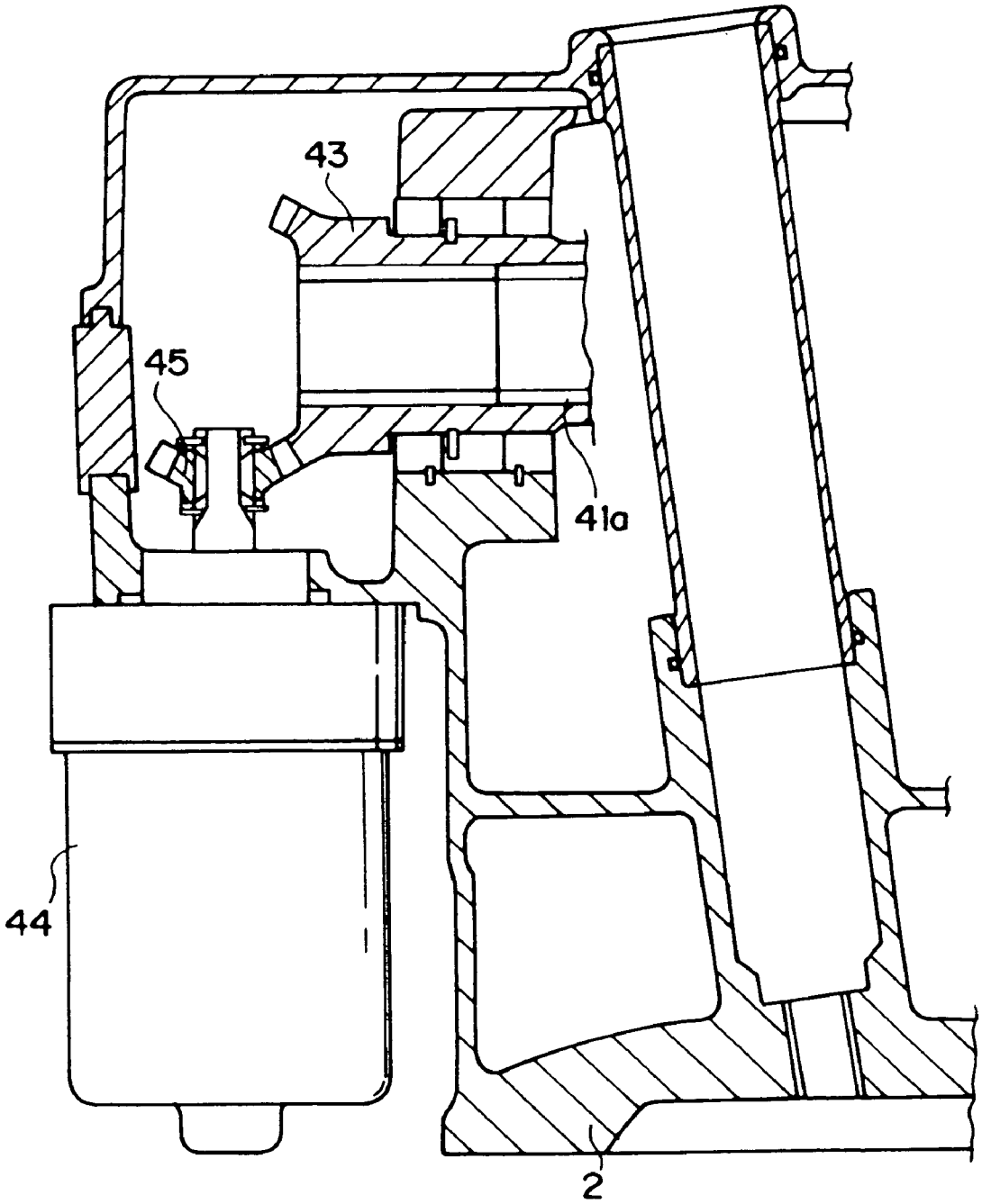
FIG. 6 is a view showing a rotation drive system of an accelerator shaft according to the valve driving apparatus of the present invention.

The accelerator shaft 41 is supported slidably in an axial direction, and screwed into a driven gear 43 (bevel gear) via a feed screw 41*a* at one end side. The driven gear 43 is rotatably supported at the cylinder head 2, and is meshed with a drive gear 45 (bevel gear) fixed to an output shaft of an accelerator motor 44 as shown in FIG. 6.

The accelerator fork 42 extends to the sides of the camshafts 11 and $11_{EX}$ in a direction perpendicular to the accelerator shaft 41, and has tip end portions each in a bifurcated shape. At end portions of the cams 13 and $13_{EX}$, fork guides 47 and $47_{EX}$ rotatable via bearings 46 and $46_{EX}$ are included. The tip ends each in a bifurcated shape of the accelerator fork 42 are engaged with engaging grooves of the fork guides 47 and $47_{EX}$, and are movable along the engaging grooves. As a result, the cams 13 and $13_{EX}$ respectively slide along the camshafts 11 and $11_{EX}$, interlocked or synchronously with the accelerator shaft 41 sliding in its axial direction.

Here, in the above-described embodiment, when an accelerator grip (or accelerator pedal) is operated, the accelerator motor 44 is actuated, and by the rotation of its output shaft, the accelerator shaft 41 slides via the driven gear 43. The cams 13 and $13_{EX}$ slide along the camshafts 11 and $11_{EX}$, interlocked with the movement of the accelerator shaft 41 via the accelerator fork 42. In this embodiment, the continuously variable control of the valve lift amount and the actuated angle is also performed in accordance with the accelerator opening degree at the exhaust side in addition to the intake side.

The intake and exhaust amount is thus controlled from an idle rotation range to a full opened range, and intake and exhaust which are the most suitable for the engine rotation speed (or vehicle speed) can be performed. For example, at a time of low engine speed, the tappet roller 21 abuts on the cam surfaces 13*a* and 13$a_{EX}$ of the cams 13 and 13$_{EX}$ at a region with comparatively low cam height. When acceleration is performed, that is to say, the accelerator is opened in this state, the driven gear 43 is rotated by the actuation of the accelerator motor 44, and the accelerator shaft 41 slides in the direction of the arrow in FIG. 5. The cams 13 and 13$_{EX}$ similarly slide in the direction of the arrow along the camshafts 11 and 11$_{EX}$, interlocked with the movement of the accelerator shaft 41 via the accelerator fork 42. As a result that the cams 13 and 13$_{EX}$ slide, the tappet rollers 21 and 21$_{EX}$ gradually abut on the region with comparatively high cam height, and the valve lift amount is increased. Meanwhile, at a time of deceleration, the accelerator is returned, whereby the valve lift amount is decreased by the reverse operation from the above operation.

According to the present invention, a three-dimensional cam which drives a valve has cam top portions formed to have a smoothly ranged edge line substantially along its rotation axis direction, and a part of the edge line includes at least one valley portion to take on a row of peaks. In this embodiment, the present invention is applied to the cam 13$_{EX}$ at the exhaust side.

Figure 8:
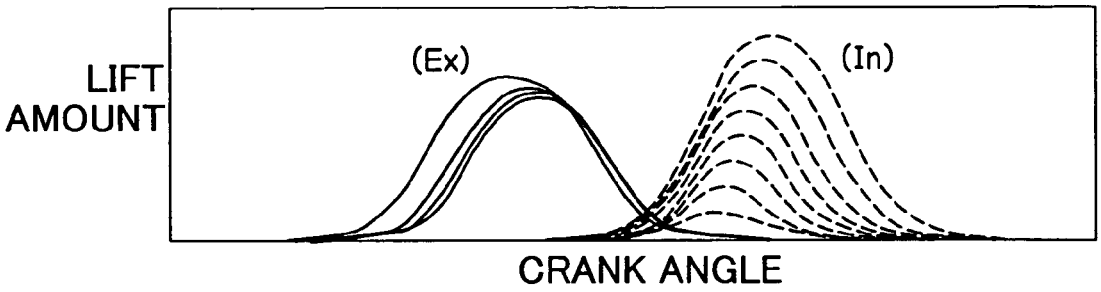
FIG. 8 is a view showing the valve lift characteristic according to an embodiment of the valve driving apparatus of the present invention.

FIGS. 7A to 7D show examples of a three-dimensional cam 200. The three-dimensional cam 200 consists of uncountable cam top portions continuously ranged along the direction of rotation axis X, so as to change the cam height and the cam operation angle continuously, and the respective cam top portions have cam profiles different from each other but in general have similar figures. As for the cam 13 at the intake side, it may be a cam lobe having a profile of a toneless one side rising form as shown in FIG. 8.

In this example, the three-dimensional cam 200 has cam top portions (or cam profile) 201 to 204 along the direction of rotation axis X, and the respective cam top portions have cam peak portions (or a ridge of cam top portions) 201*a* to 204*a* that are being the most projected portions from a base circle 210. The rotation axis X of the three-dimensional cam 200 accords with the longitudinal axis of the camshaft 11$_{EX}$, and one end side along the direction of rotation axis X (cam top portion 201 side) corresponds to a low engine rotation region, and the other end side (cam top portion 204 side) corresponds to a high engine rotation region. A range of the cam peak portions 201*a* to 204*a* forms an edge line 211 of a cam lobe of the three-dimensional cam 200. The edge line 211 is not set linearly in the direction of rotation axis X, and this means that the angle $\alpha$ made by each cam peak portion (for example, the cam peak portion 202*a* in FIG. 7B) with the rotation axis X varies in a slight angle range.

As shown in FIG. 7C, the edge line 211 becomes higher as it goes to the cam top portion 204 side in general, and in this example, the edge line 211 takes on the row of peaks to be a valley portion at the cam top portion 202. In this case, the cam peak portion 202*a* of the cam top portion 202 which forms a valley portion is moderately set to be deviated toward a delayed side with reference to the rotation direction of the three-dimensional cam 200 from the other cam peak portions 201*a*, 203*a*, and 204*a* of the edge line 211.

The single cam top portion 202 is shown in the drawing, but many cam top portions including this cam top portion 202 form a continuous valley portion 212 relative to the cam top portions 201 and 203 on both sides along the direction of rotation axis X, and also set to be deflected at one end side of the three-dimensional cam 200. The cam top portion 203 at the other end side of the three-dimensional cam 200 forms a ridge portion in this case.

The cam top portion 202 forms the continuous valley portion 212 along the rotation direction between the cam top portions 201 and 203 on both sides, and (the depth of) the valley portion 212 becomes shallower as it goes along the rotation direction to be more distant from the cam peak portion, that is to say, its height difference from the cam top portions 201 and 203 gradually becomes smaller. And at last, the respective cam top portions integrate to the base circle 210 and then such height difference disappears.

Figure 9:
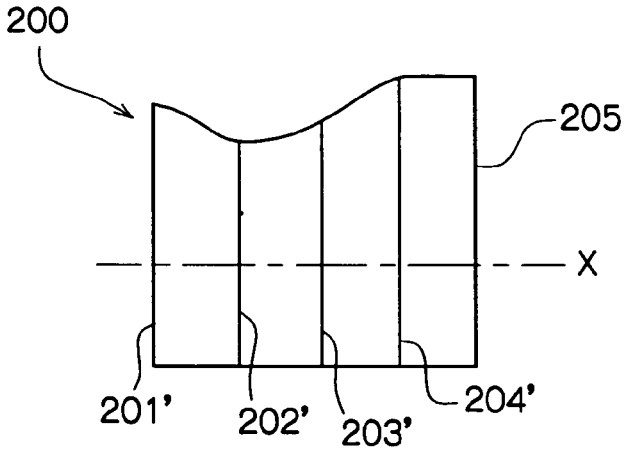
FIG. 9 is a view showing a modification example of the three-dimensional cam according to the embodiment of the valve driving apparatus of the present invention.

As shown in FIG. 9, the edge line 211 adjacent to the other end side of the three-dimensional cam 200 has a cam peak portion 204' higher enough than the cam top portion 202' to be a valley portion, and can be formed to have a ridge portion keeping the height until it goes to the cam top portion 205 at the other end along the direction of rotation axis X of the three-dimensional cam 200.

As described above, by sliding the cams 13 and 13$_{EX}$ along the camshafts 11 and 11$_{EX}$ via the accelerator fork 42, and by slidably driving the respective cams 13 and 13$_{EX}$ relative to the tappet rollers 21 and 21$_{EX}$, the valve lift amount and the actuated angle at the intake side and at the exhaust side can be continuously variable controlled. In this case, the three-dimensional cam 200 especially constituting the cam 13$_{EX}$ at the exhaust side is not a cam lobe having a cam profile with mere one side rising form, that is to say, the edge line 211 takes on a row of peaks having a valley portion at the cam top portion 202. Therefore, when the cam 13$_{EX}$ and the tappet roller 21$_{EX}$ make relative motions, that is to say, for example, as shown in FIG. 7C, the tappet roller 21$_{EX}$ makes a relative motion in a direction of rotation axis X from a low engine rotation region to a high engine rotation region, the tappet roller 21$_{EX}$ comes in contact with the cam 13$_{EX}$ at the left side region in the drawing in an early stage, and comes in contact with the cam 13$_{EX}$ at the right side region after passing through the cam top portion 202. Meanwhile, on the contrary, when the tappet roller 21$_{EX}$ makes a relative motion from the high engine rotation region to the low engine rotation region, the contact region of the tappet roller 21$_{EX}$ changes from the right side to the left side.

As described above, when the cam 13$_{EX}$ and the tappet roller 21$_{EX}$ make relative motions, in this example, the loading direction for the tappet roller 21$_{EX}$ is changed in the vicinity of the cam top portion 202, that is to say, the loading provided in a moving direction and the loading provided in a direction perpendicular to the moving direction range with adequate variation. Thereby an abrasion on the sliding surface of the accelerator shaft unit 40, especially of the accelerator fork 42 or the fork guide 47$_{EX}$, which is a driving system to drive a relative motion of the tappet roller 21$_{EX}$, can be restrained, and a durability thereof can be improved. Besides, the contact point of the tappet roller 21$_{EX}$ (spherical terminal) can be extended into a broad area of a sphere, thereby a durability of a tappet can be improved.

Besides, the cam peak portion 202*a* of the cam top portion 202 forming a valley portion is moderately set to be deviated toward a delayed side with reference to the rotation direction of the three-dimensional cam 200 from the other cam peak portions 201*a*, 203*a*, and 204*a*. In this way, the position of the cam peak portion 202*a* of the cam top portion 202 forming a valley portion is deviated toward the delayed side with reference to the rotation direction from the positions of the cam peak portion 201*a* of the cam top portion 201 at the end face of one end side along the direction of rotation axis X, and the cam peak portion 204*a* of the cam top portion 204 at the end face of the other end side, thereby, when the three-dimensional cam 200 is used as the cam 13$_{EX}$ at the exhaust side, the cam profiles as a whole move to a delayed angle side while the engine rotation speed is in the low rotation region, in the transition segment from the low to the middle rotation region, and in the middle rotation region. In this way, the exhaust valve is delayed in its closed timing, so that the lapping segment (overlap) with the intake cam in the intake process which is a post process of the exhaust process becomes large, and the intake and exhaust efficiency is optimized, thereby a favorable engine characteristic can be obtained. In the very low engine rotation region such as an idling mode, or in the high engine rotation region, the amount of overlap should be rather small from, for example, the point of the stability of engine rotation and/or, the engine power.

The cam top portion 202 to be a valley portion is set to be deflected at one end side of the three-dimensional cam 200 as a continuous valley portion 212. Especially when this is combined with the above-described embodiment that the cam peak portion 202*a* of the cam top portion 202 is set to be deviated toward a delayed side with reference to the rotation direction of the three-dimensional cam 200, the intake and exhaust efficiency becomes the best status in all over the engine rotation regions. Besides, the high power status is obtained in the high rotation region side.

Further, the three-dimensional cam 200 has in the vicinity of the other end side the cam peak portion 204' high enough than the cam top portion 202' to be a valley portion, and the height is kept until it goes to the cam top portion 205 at the other end along the direction of rotation axis X of the three-dimensional cam 200. Especially when this embodiment is combined with the above-described embodiment that the cam top portion 202 is set to be deflected at one end side of the three-dimensional cam 200, both the optimization of the filling efficiency of the air-fuel intake mixture in the high rotation region of an engine and enhancement of the engine power can be obtained.

Usually, even if the height of a cam top portion is changed during the transition segment from a middle rotation region to a high rotation region, and further in a high rotation region of engine rotation speed, the adequate power change cannot be obtained. When the height of a cam top portion, in other words, the lift height is the same, and the operation angle is changed, the angle of gradient in a circumferential direction in a cam profile is changed, thereby a harmful result becomes can occur in that matching a spring constant of a valve spring becomes difficult. Therefore, the height of the cam top portion 205 at the other end side of the three-dimensional cam 200 is kept high, in other words, it is kept substantially constant. Moreover, the shape of the three-dimensional cam 200 is simplified as is described, thereby the productivity is improved.

Here, in this embodiment, the example that the three-dimensional cam 200 (cam $\mathbf{13}_{EX}$), in other words, the cam lobe is moved, is explained, but it can be constituted such that the valve lifter side (tappet, and tappet guide (including the case of rocker arm)) is moved, and the similar effect as is described above can also be obtained in that case.

Besides, the example that the accelerator fork 42 is driven by the accelerator shaft 41 as a driving means of a cam lobe is described, but it can be constituted such that, for example, an actuator including a vane pump and a helical spline is combined coaxially with a camshaft, and the similar effect as is described above can also be obtained in that case.

Furthermore, a cam lifter for a decompressor can be attached at the cam position for idling corresponding to the low rotation region side of the engine.

Next, another embodiment of a valve driving apparatus in the present invention is explained.

In this embodiment, a three-dimensional cam has cam top portions formed to have a smoothly ranged edge line substantially along its rotation axis direction, and a part of the edge line includes at least one ridge portion which is set to be high relative to cam top portions on both sides along the direction of rotation axis to take on a row of peaks.

FIGS. 10A to 10D show concrete constitution examples of a three-dimensional cam 200 which composes a cam $\mathbf{13}_{EX}$ in this embodiment. The three-dimensional cam 200 consists of uncountable cam top portions continuously ranged along the direction of rotation axis X, so as to change the cam height and the cam operation angle continuously, and the respective cam top portions have cam profiles different from each other but in general having similar figures.

In this example, the three-dimensional cam 200 has cam top portions 201 to 204 along the direction of rotation axis X, and the respective cam top portions have cam peak portions 201*a* to 204*a* which are the most projected portions from a base circle 210. The rotation axis X of the three-dimensional cam 200 accords with the longitudinal axis of the camshaft $\mathbf{11}_{EX}$, and one end side along the direction of rotation axis X (cam top portion 201 side) corresponds to a low engine rotation region, and the other end side (cam top portion 204 side) corresponds to a high engine rotation region. A range of the cam peak portions 201*a* to 204*a* forms an edge line 211 of a cam lobe of the three-dimensional cam. The edge line 211 is not set linearly in the direction of rotation axis X, and this means that the angles $\alpha$ made by the respective cam peak portions (for example, the cam peak portion 202*a* in FIG. 10B) with the rotation axis X vary in a slight angle range.

In this example, the cam top portion 202 disposed in the direction of one end side of the three-dimensional cam 200 is formed to have a ridge portion set to be high relative to the cam top portions 201 and 203 on both sides along the direction of rotation axis X. This ridge portion takes on a row of peaks to form a continuous ridge portion 213 in the rotation direction.

Besides, the cam top portion 203 in the direction at the other end side of the three-dimensional cam 200 is formed to have a valley portion set to be low relative to the cam top portions 202 and 204 on both sides along the direction of rotation axis X, that is to say, it forms a continuous valley portion 214 along the rotation direction between the cam top portions 202 and 204 on both sides. Thus, the ridge portion 213 and valley portion 214 take on a mountain fold state.

When the cam $\mathbf{13}_{EX}$ and a tappet roller $\mathbf{21}_{EX}$ make relative motions, that is to say, for example, as shown in FIG. 10C, the tappet roller $\mathbf{21}_{EX}$ makes a relative motion from a low engine rotation region to a high engine rotation region in the direction of rotation axis X, the tappet roller $\mathbf{21}_{EX}$ comes in contact with the cam $\mathbf{13}_{EX}$ at the right side region in the drawing in an early stage, comes in contact with the cam $\mathbf{13}_{EX}$ at the left side region after passing through the cam top portion 202, and further comes in contact with the cam $\mathbf{13}_{EX}$ at the right side region after passing through the cam top portion 203. On the contrary, when the tappet roller $\mathbf{21}_{EX}$ makes a relative motion from a high engine rotation region to a low engine rotation region, the contact region of the tappet roller $\mathbf{21}_{EX}$ changes in a reverse order from the above description.

Also in the second embodiment, when the cam $\mathbf{13}_{EX}$ and the tappet roller $\mathbf{21}_{EX}$ make relative motions, the loading direction for the tappet roller $\mathbf{21}_{EX}$ is changed in the vicinity of the cam top portion 202, and in the vicinity of the cam top portion 203 in this example, that is to say, the loading provided in the moving direction and the loading provided in a direction perpendicular to the moving direction range with adequate variation. Thereby abrasion can be restrained on the sliding surface of an accelerator shaft unit 40, especially of an accelerator fork 42 or a fork guide $\mathbf{47}_{EX}$, which is a driving system to drive a relative motion of the tappet roller $\mathbf{21}_{EX}$, and a durability thereof can be improved. Besides, the contact point of the tappet roller $\mathbf{21}_{EX}$ (spherical terminal) can be extended into a broad area of a sphere, thereby a durability of a tappet can be improved.

Next, a further embodiment of a valve driving apparatus in the present invention is explained.

In this embodiment, the present invention is applied to a cam 13 at an intake side. FIG. 11A to 11C show examples of a three-dimensional cam 200 which composes a cam 13 in the third embodiment. The three-dimensional cam 200 has cam top portions 201 to 204 along the direction of rotation axis X, and the respective cam top portions have cam peak portions 201*a* to 204*a* being the most projected portions from a base circle 210. The rotation axis X of the three-dimensional cam 200 accords with the longitudinal axis of a camshaft 11, and at one end side along the direction of rotation axis X (cam top portion 201 side) corresponds to a low engine rotation region, and the other end side (cam top portion 204 side) corresponds to a high engine rotation region. A range of the cam peak portions 201*a* to 204*a* forms an edge line 211 of a cam lobe of the three-dimensional cam 200.

In this example, the three-dimensional cam 200 has a cam top portion 206 for idling (low-speed rotation region) especially at high temperature or around the room temperature, and further has cam top portions 207 to 209 for starting which is formed to lift an intake valve 31 a very little amount at around the later stage of the intake process in the very low-speed engine rotation region. The cam top portions 207 to 209 for starting are set to be substantially the same or higher cam height as the lowest cam height of a cam lobe of the three-dimensional cam 200. The cam top portions 201 to 204, the cam top portion 206 for idling, and the cam top portions 207 to 209 for starting are formed with a continuous curve to draw a smooth lift curve.

Figure 12A:
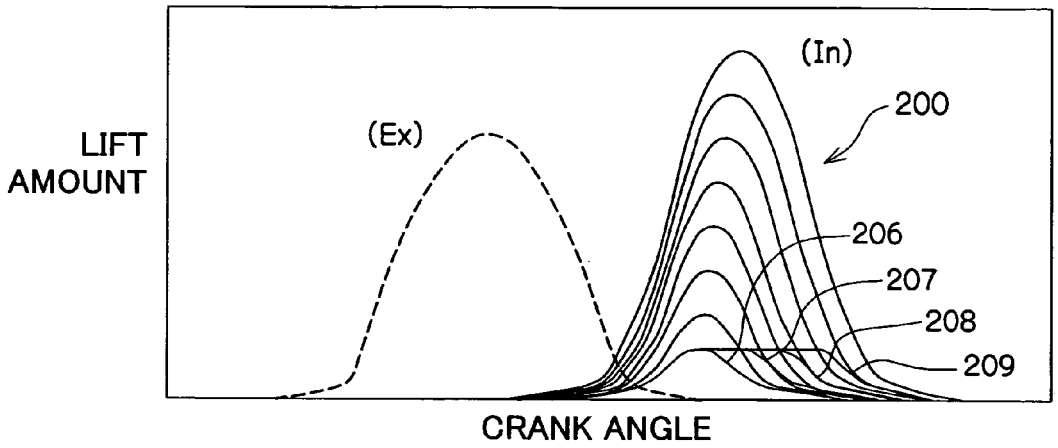
FIGS. 12A and 12B are views showing the valve lift characteristic according to the embodiment of the valve driving apparatus of FIGS. 11A–11C of the present invention.
Figure 12B:
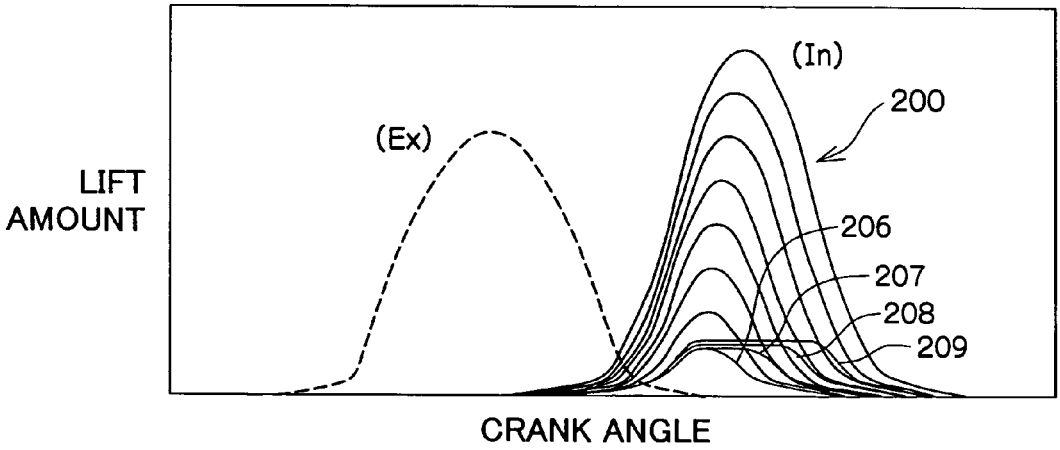
Figure 13:
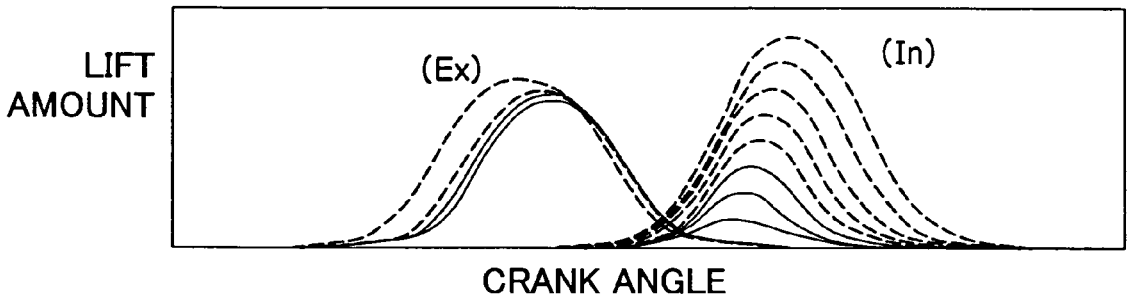
FIG.13 PRIOR ART
FIG. 13 is a view showing a valve lift characteristic of a conventional cam.
Figure 14:
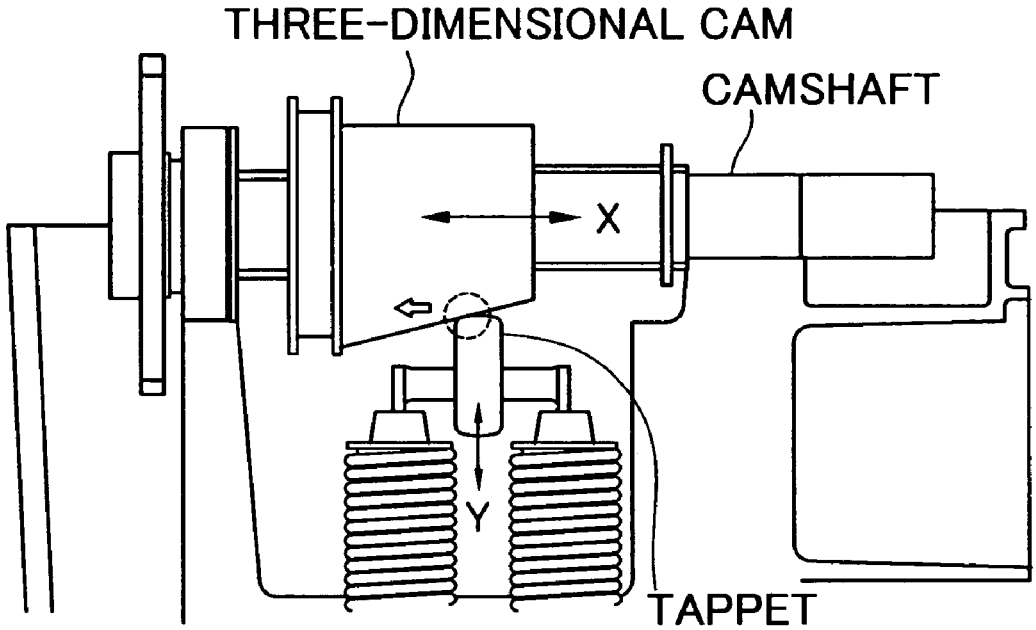
FIG.14 PRIOR ART
FIG. 14 is a view showing a constitution example of a peripheral part of the conventional cam.

In this case, for example, as shown in a valve lift curve in FIG. 12A, the cam top portions 207 to 209 for starting are set to be substantially the same cam height, and operation angles of the respective cam top portions are set to become gradually larger. The opening timings of the intake valve 31 by the respective cam top portions 207 to 209 are set to be the same. Besides, as shown in a valve lift curve in FIG. 12B, the cam height and the operation angle of the cam top portions 207 to 209 for starting are set to be gradually larger.

In this embodiment, at the starting time at low temperature or during the idling mode after that, a tappet roller 21 is particularly brought into contact with the cam top portions 207 to 209 for starting and the cam top portion 206 for idling of the cam 13. The tappet roller 21 abuts on these cam top portions, thereby the intake valve 31 is opened along those lift curves. In other words, at around the later stage of the intake process, the intake valve 31 is lifted a very little amount, and after passing through a bottom dead center of the intake process, the intake valve 31 is closed, that is to say, the intake valve 31 is delayed in its valve closed timing at the starting time at low temperature. In this manner, the intake valve 31 is delayed in its valve closed timing, thereby a low temperature state caused by an adiabatic expansion is prevented, the temperature of an air-fuel mixture at the top dead center during the compression process is ascended, in particular, the ignition quality at the starting time at low temperature is improved, and also, the duration stability in the idling mode thereafter can be secured.

In the third embodiment, after the starting of engine, or after the idling status thereafter, when the tappet roller 21 makes a relative motion in the rotation axis X direction from the low engine rotation region to the high engine rotation region, the contact region of the tappet roller 21 relative to the cam 13 is changed. Therefore, also in this case, the loading direction for the tappet roller 21 is changed, that is to say, the loading provided in the moving direction and the loading provided in a direction perpendicular to the moving direction range with adequate variation. Thereby an abrasion on the sliding surface of an accelerator fork 42 or a fork guide 47 can be restrained, and a durability thereof can be improved. Besides, the contact point of the tappet roller 21 can be extended into a broad area of a sphere, thereby a durability of a tappet can be improved.

As an embodiment of the three-dimensional cam 200, for example, an intermediate portion in the rotation axis direction of cam top portions is set to have the lowest lift so as to correspond to a low engine rotation region, and both end portions correspond to a middle or a high engine rotation region. And, one side in the rotation axis direction is set to be used for starting at low temperature, and the other side is set to be used for warming up (at completion), therefore symmetrically constitution in the rotation axis direction is possible.

The present invention is explained with the various embodiments thus far, but the present invention is not limited to only these embodiments, and modifications and the like can be made within the scope of the present invention.

For example, the concrete numerical example and the like explained in the above described embodiments are not necessarily limited to these, and modifications can be made if necessary. Further, in each of the embodiments, the example in the case of a single-cylinder engine is explained, but the present invention is also effectively applicable to engines with two or more cylinders.

According to the present invention, continuously variable control of the valve lift amount, the operation angle, and the lift timing is performed in accordance with the accelerator opening degree in this type of valve driving apparatus. In this case, the three-dimensional cam is not a cam lobe having a cam profile with mere one side rising form, and for example, takes on a row of peaks having a valley portion in the way. When the cam and the tappet roller make relative motions, the contact region of the tappet roller is changed. Therefore, the loading direction for the tappet roller is changed, that is to say, the loading provided in a moving direction and the loading provided in a direction perpendicular to the moving direction range with adequate variation. Thereby an abrasion on the sliding surface of the driving system or the like to drive a relative motion of the tappet roller can be restrained, and a durability can be improved. Besides, the contact point of the tappet roller (spherical terminal) can be extended into a broad area of a sphere, thereby a durability of a tappet can be improved. As described above, by improving the durability, proper and smooth operation for a long term is assured, which, as a result, contributes to the assurance of safety.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A valve driving apparatus comprising:

a three-dimensional cam of a three-dimensional map state, having uncountable cam profiles continuously ranged along a rotation axis direction; and a valve lifter following a cam surface of said three-dimensional cam, wherein a lift characteristic of a valve is continuously controlled by relative motions of said three-dimensional cam and said valve lifter, and wherein said three-dimensional cam has cam top portions formed to have a smoothly ranged edge line substantially along the rotation axis direction thereof, and a part of the edge line includes at least one valley portion to take on a row of mountains;

wherein a cam peak portion of the cam top portion formng the valley portion is moderately set to be deviated toward a delayed side with reference to the rotation direction of said three-dimensional cam from the other cam peak portions of the edge line; and wherein one end side of said three-dimensional cam corresponds to a low engine rotation region, and the other end side corresponds to a high engine rotation region, and the cam top portion to be the valley portion of the edge line forms a continuous valley portion relative to the cam top portions on both sides along the direction of rotation axis, and also is set to be deflected at one end side of said three-dimensional cam.

2. The valve driving apparatus according to claim 1, wherein the edge line adjacent to the other end side of said three-dimensional cam has a cam peak portion high enough than the cam top portion to be the valley portion, and is formed to have a ridge portion keeping the height along the rotation axis direction.

3. A valve driving apparatus comprising:

a three-dimensional cam of a three-dimensional map state, having uncountable cam profiles continuously ranged along a rotation axis direction; and a valve lifter following a cam surface of said three-dimensional cam, wherein a lift characteristic of a valve is continuously controlled by relative motions of said three-dimensional cam and said valve lifter, wherein said three-dimensional cam has cam top portions formed to have a smoothly ranged edge line substantially along the rotation axis direction thereof, and a part of the edge line includes at least one valley portion and at least one ridge portion which is set to be high relative to the cam top portions on both sides along the direction of rotation axis to take on a row of peaks, thus, the valley portion and ridge portion form continuous valley portion and ridge portion along the rotation direction of said three-dimensional cam, to take on a mountain fold state.

4. An internal combustion engine controlling intake and exhaust by intake valves and exhaust valves, comprising:

the valve driving apparatus according to claim 1, at an intake side or an exhaust side.

* * * * *